United States Patent [19]

Guglielmetti et al.

[11] Patent Number: 4,891,153

[45] Date of Patent: Jan. 2, 1990

[54] MIXTURES OF FLUORESCENT WHITENING AGENTS

[75] Inventors: Leonardo Guglielmetti, Bottmingen, Switzerland; Hans R. Meyer, Binningen, Switzerland; Dieter Reinehr, Kandern, Fed. Rep. of Germany; Kurt Weber, Basel, Switzerland

[73] Assignee: CIBA-GEIGY Corporation, Ardsley, N.Y.

[21] Appl. No.: 228,643

[22] Filed: Aug. 5, 1988

Related U.S. Application Data

[62] Division of Ser. No. 25,023, Mar. 12, 1987, Pat. No. 4,778,622.

[30] Foreign Application Priority Data

Mar. 21, 1986 [CH] Switzerland ..... 1142/86

[51] Int. Cl.[4] ..... C09K 11/06

[52] U.S. Cl. ..... 252/301.22; 252/301.21; 558/373

[58] Field of Search ..... 252/301.21, 301.22; 558/373

[56] References Cited

U.S. PATENT DOCUMENTS

| | | | |
|---|---|---|---|
| 3,294,570 | 12/1966 | Pommer et al. | 427/158 |
| 4,330,427 | 5/1982 | Martini et al. | 252/301.21 |
| 4,380,514 | 4/1983 | Seybold | 252/301.21 |
| 4,464,284 | 8/1984 | Seybold | 252/301.21 |

FOREIGN PATENT DOCUMENTS 0023027 1/1981 European Pat. Off. .

OTHER PUBLICATIONS

Chemical Abstract 94, 158322g, (1981), Horst et al.

*Primary Examiner*—John F. Niebling
*Assistant Examiner*—Steven P. Marquis
*Attorney, Agent, or Firm*—Edward M. Roberts

[57] ABSTRACT

Mixtures of fluorescent whitening agents consisting of 51 to 99% by weight of a symmetrically or unsymmetrically substituted first 1,4-bis(cyanostyryl)benzene and 49 to 1% by weight of an unsymmetrically substituted second 1,4-bis(cyanostyryl)benzene that differs from the first, a process for the preparation of said mixtures by condensing terephthalaldehyde with a di($C_1$–$C_4$)alkylphosphonomethylbenzonitrile to cyano-4-formylstilbene, which is further condensed, either direct or after isolation, with at least one other di($C_1$–$C_4$)alkylphosphonomethylbenzonitrile, the use of these mixtures for whitening polyester fibres, and compositions containing said mixtures for whitening polyester fibres.

5 Claims, No Drawings

MIXTURES OF FLUORESCENT WHITENING AGENTS

This is a divisional of application Serial No. 025,023 filed on Mar. 12, 1987 Pat. No. 4,778,622, issued 10/18/88.

Fluorescent whitening agents are often used as mixtures of two or more different types. The reason is that such mixtures exhibit a synergistic effect, as the degree of whiteness of the mixture is greater than that of the same amount of each of the individual components. Mixtures of fluorescent whitening agents consisting of 51 to 99% by weight of an unsymmetrically substituted 1,4-bis(styryl)benzene and 49 to 1% by weight of a symmetrically substituted 1,4-bis(styryl)benzene have already been disclosed in European patent application EP-A 30917. Cyano and/or an esterified carboxyl group are named as substituents.

The present invention relates to mixtures of fluorescent whitening agents having enhanced properties and consisting of 51 to 99% by weight of a symmetrically or unsymmetrically substituted first compound of formula

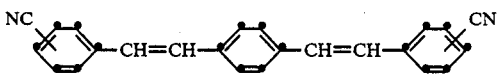

(1)

and 49 to 1% by weight of an unsymmetrically substituted second compound of formula 1 that differs from the first compound.

Preferred mixtures consist of one of the compounds of formula

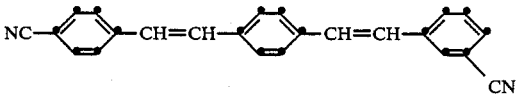

(2)

or of formula

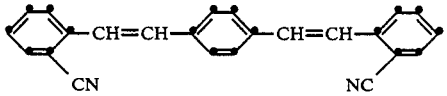

(4)

with in each case the compound of formula

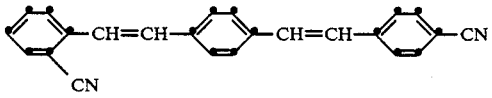

(3)

with the preferred ratio being 75 to 85% by weight of one of the compounds of formulae (2) and (4) to 25 to 15% by weight of the compound of formula (3).

The mixtures of this invention are prepared by condensing terephthalaldehyde with a di($C_1$–$C_4$)alkylphosphonomethylbenzonitrile and further condensing the resultant cyano-4-formylstilbene of formula

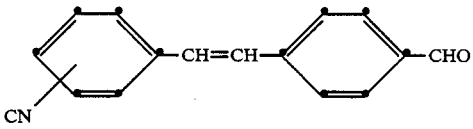

(5)

either direct or after isolation thereof, with at least one other di($C_1$–$C_4$)alkylphosphonomethylbenzonitrile. To isolate the intermediate, the reaction of terephtalaldehydre with a di($C_1$–$C_4$)alkylphosphonomethylbenzonitrile is caried out in the presence of an alkali metal hydroxide and water, and the precipitated cyano-4-formylstilbene of formula (5) is isolated by filtration.

Mixtures of compounds of formulae (2) and (3) are prepared by condensing terephthalaldehyde with a 4-di($C_1$–$C_4$alkylphosphonomethylbenzonitrile and further condensing the resultant 4-cyano-4'-formylstilbene with a 3-di($C_1$-$C_4$)alkylphosphonomethylbenzonitrile and a 2-di($C_1$-$C_4$)alkylphosphonomethylbenzonitrile.

The process for the preparation of mixtures of the compounds of formula (4) and (3) is a variant of the above process and comprises condensing terephthaldehyde, a 2-di($C_1$–$C_4$)alkylphosphonomethylbenzonitrile and a 4-di($C_1$–$C_4$)aklylphosphonomethylbenzonitrile simultaneously with one another.

The present invention further relates to the preparation and isolation of the intermediates of formula (5)

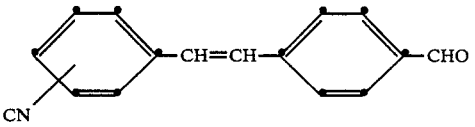

(5)

The cyano-4-formylstilbenes can be obtained in particularly good yield and purity by condensing terephthalaldehyde and dialkylphosphonomethylbenzonitriles using an aqueous alkali metal hydroxide, e.g. sodium hydroxide or, preferably, potassium hydroxide, as proton acceptor. This result is surprising, as aromatic aldehydes are known to undergo Cannizzaro reactions with aqueous alkali metal hydroxides to form carboxylic acids and alcohols. The presence of water makes the reaction particularly selective with respect to the monocondensation to cyano-4-formylstilbenes by substantially preventing the further condensation to the symmetrical di(cyanostyryl)benzene, thus affording an advantage over the alkali metal alcoholates normally used. The additional use of a lower aliphatic alcohol containing 1 to 3 carbon atoms, especially methanol, further facilitates the process. It is not necessary to use an excess of terephthalaldehyde, i.e. approximately molar amounts of terephthalaldehyde and phosphonate are used. The reaction temperature is kept in the range from 0°to 30° C., and the amount of alkali is from 1 to 2 moles per mole of terephthalaldehyde. The water content of the alkali metal hydroxide employed varies within a wide range, preferably from 1 to 80%. The 4-cyano-4'-formylstilbene can be especially readily obtained by this method.

Further objects of the present invention are the use of the mixtures of the two different compounds of formula (1) for whitening polyester fibres, and also compositions for whitening polyester fibres, said compositions containing a mixture of 51 to 99% by weight of a symmetrically or unsymmetrically substituted first compound of formula

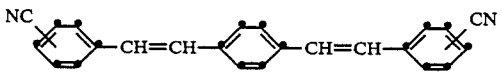

(1)

and 49 to 1% by weight of an unsymmetrically substituted second compound of formula I that differs from the first compound.

Preferably these compositions contain mixtures of compounds of formula

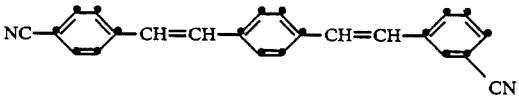

(2)

or of formula

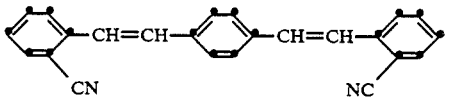

(4)

with in each case the compound of formula

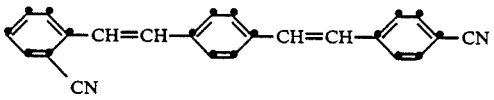

(3)

with the preferred ratio being 75 to 85% by weight of one of the compounds of formulae (2) and (4) to 25 to 15% by weight of the compound of formula (3).

As is customary with mixtures of fluorescent whitening agents, the individual components can be processed to the commercial form by dispersing them in a liquid medium. This can be done by dispersing the individual components and then combining the dispersions so obtained. However, it is also possible to mix the individual components together in substance and then to disperse them jointly. This dispersing operation is carried out in conventional manner in ball mills, colloid mills, bead mills or the like. The mixtures of this invention and the compositions containing them are most suitable for whitening textile material made from linear polyesters. However, these mixtures and compositions can also be used for whitening blends that contain linear polyesters.

The mixtures of this invention are applied by the methods normally employed for the application of fluorescent whitening agents, for example by the exhaust dyeing process in dyeing machines or by pad-thermofixation. The treatment is conveniently effected in an aqueous medium in which the compounds are present in finely particulate form as suspensions, microdispersions or, as the case may be, solutions. If appropriate, dispersants, stabilisers, wetting agents and other assistants can be added during the treatment. The treatment is normally carried out in the temperature range from about 20° to 140° C., for example at the boiling temperature of the bath or in the proximity thereof.

In the following Examples, w/v denotes weight by volume and HPLC stands for high performance liquid chromatography.

EXAMPLE 1

134.1 g of terephthalaldehyde, 455.8 g of 2-diethylphosphonomethylbenzonitrile and 50.6 g of 4-diethylphosphonomethylbenzonitrile are dissolved at room temperature in 750 ml of dimethylformamide. Then 396 g of 30% sodium methylate solution are added dropwise such that the reaction temperature does not exceed 45° C. The resultant yellow suspension is stirred for 4½ hours, the temperature gradually falling from 45° C. to 25° C. (volume: about 1800 ml). After cooling to 0° to 5° C., 700 ml of methanol and 30 ml of acetic acid are added. The neutral yellow suspension is stirred for ¼ hour and filtered with suction. The filter cake is washed first with methanol and then with water until salt-free and dried in a vacuum drying cabinet at 100° C., affording 287.6 g of a yellow product consisting of 80% by weight of 1,4-bis(2-cyanostyryl)benzene and 20% by weight of 1-(2-cyanostyryl)-4-(4-cyanostyryl)benzene, corresponding to a yield of 86.5% of theory.

EXAMPLE 2

67.5 g of terephthalaldehyde and 127 g of diethylphosphonomethylbenzonitrile are condensed in 500 ml of methanol with 70 g of powdered potassium hydroxide (88%) as condensing agent to 4-cyano-4'-formylstilbene, which, without isolation, is further condensed with 118.5 g of 3-diethylphosphonomethylbenzonitrile and 28.5 g of 2-diethylphosphonomethylbenzonitrile. Yield: 124.3 g of a product consisting of 80.25% by weight of 1-(4-cyanostyryl)-4-(2-cyanostyryl)benzene and 19.75% by weight of 1-(4-cyanostyryl)-4-(2-cyanostyryl)benzene, corresponding to 75% of theory.

EXAMPLE 3

(Isolation of the Intermediate)

With stirring, cooling and blanketing with nitrogen, 6.7 g of terephthalaldehyde are added in portions to a mixture of 6.2 ml of aqueous potassium hydroxide solution 50% w/v and 40 ml of methanol, such that the temperature does not exceed 22° C. The resultant solution is then treated dropwise at 10° C. over ½ hour with a solution of 12.7 g of p-diethylphosphonomethylbenzonitrile (99.5%) in 10 ml of methanol, whereupon the reaction product soon precipitates. After stirring overnight at 10° C., the thick suspension is neutralised with 3 ml of glacial acetic acid, diluted with 40 ml of water, and filtered with suction. The filter residue is washed repeatedly with a 3:2 mixture of methanol/water and then with water until salt-free and dried under vacuum at 80° C., affording 10.6 g of 4-cyanostilbene-4'-aldehyde as a pale yellow powder.

Instead of p-diethylphosphonemethylbenzonitrile, it is also possible to use the equivalent amount of p-dimethylphosphonomethylbenzonitrile.

4-Cyanostilbene-4'-aldehyde is obtained in a yield of 10.2 g by using 28 g of 20% aqueous potassium hydroxide solution (w/v) instead of 50% potassium hydroxide, keeping the temperature at 0°–5° C. and otherwise carrying out the procedure described in this Example.

4-Cyanostilbene-4'-aldehyde is obtained in similar yield by using an equivalent amount of 88% aqueous potassium hydroxide instead of 50% potassium hydroxide solution.

EXAMPLE 4

(Isolation Of The Intermediate)

6.7 g of terephthaldehyde are reacted with 12.8 g of m-diethylphosphonomethylbenzonitrile (99.2%) in accordance with Example 1. The reaction temperature is kept initially at 0°–5° C. for ½ hour and allowed to rise overnight to 22° C. 3-Cyanostilbene-4'-aldehyde containing 2% of 1,4-di(m-cyanostyryl)benzene is obtained in a yield of 8.0 g after working up as described in Example 1, but without dilution with water.

EXAMPLE 5

With stirring, 70 g of powdered potassium hydroxide (88%) are added at 2° C. to 800 ml of methanol. Then 134 g of terephthalaldehyde are added and a solution of 253 g of 4-diethylphosphonomethylbenzonitrile in 200 ml of methanol is added dropwise at 2° C. over ¼ hours. The thick yellow slurry is stirred for 2 hours at 2° C., then for 2 hours at 25° C. and, finally, for 2 hours at 40° C. After cooling to 0° C., 300 ml of methanol are added and the crystallised 4-cyano-4'-formylstilbene is filtered with suction and washed with 500 ml of methanol. The well extracted filter cake is then suspended, with stirring, in 800 ml of dimethylformamide at 40° C. Then 204 g of 3-diethylphosphonomethylbenzonitrile and 52 g of 2-diethylphosphonomethylbenzonitrile are added, followed by the dropwise addition over 40 minutes of 198 g of a 30% solution of sodium methylate in methanol, while keeping the temperature below 45° C. by cooling with ice-water. The suspension is stirred for 4 hours at 40° C. and, after addition of 800 ml of methanol, neutralised with formic acid, cooled to 0° C. and filtered with suction. The filter cake is washed with 2×500 ml of methanol and dried under vacuum, affording 269 g of a mixture consisting of 80% by weight of 1-(4-cyanostyryl)-4-(3-cyanostyryl)benzene and 20% by weight of 1-(4-cyanostyryl)-4-(2-cyanostyryl)benzene.

What is claimed is:

1. A process for the preparation of a mixture of fluorescent whitening agents consisting of 51 to 99% by weight of a symmetrically or unsymmetrically substituted first compound of formula

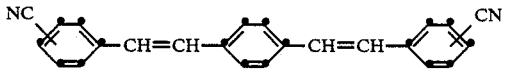

(1)

and 49% to 1% by weight of an unsymmetrically substituted second compound of formula (1) that differs from the first compound, which comprises condensing, in the presence of aqueous alkali, terephthalaldehyde with a di($C_1$–$C_4$)alkylphosphonomethylbenzonitrile and further condensing the cyano-4-formylstilbene of formula

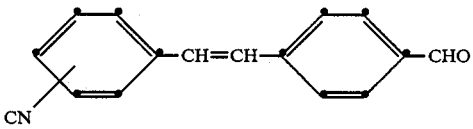

(5)

obtained as intermediate, either direct or after isolation thereof, with at least one other ($C_1$–$C_4$)alkylphosphonomethylbenzonitrile.

2. A process according to claim 1 for isolating the intermediate, which comprises carrying out the reaction of terephthalaldehyde with a di($C_1$–$C_4$)alkylphosphonomethylbenzonitrile in the presence of an alkali metal hydroxide and water, and isolating the precipitated cyano-4-formylstilbene of formula (5).

3. A process according to claim 1 for the preparation of a mixture consisting of a compound of fomrmula

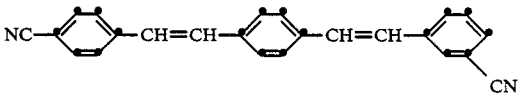

(2)

and a compound of formula

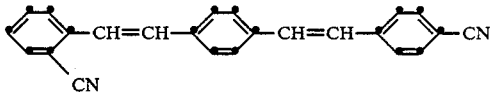

(3)

which comprises condensing terephthalaldehyde with 4-di($C_1$–$C_4$)alkylphosphonomethylbenzonitrile and further condensing the 4-cyano-4'-formylstilbene obtained as intermediate with a 3-di($C_1$–$C_4$)alkylphosphonomethylbenzonitrile and a 2-di($C_1$–$C_4$)-alkylphosphonomethylbenzonitrile.

4. A process for the preparation of a mixture of compounds of the formulae

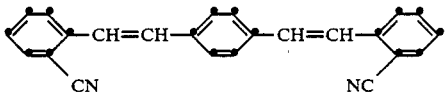

and

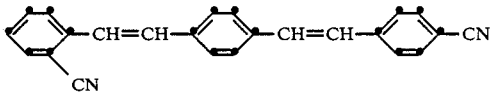

consisting of 51 to 99% by weight of one compound and 49 to 1% by weight of the other compound which comprises condensing, in the presence of aqueous alkali, terephthalaldehyde, a 2-di($C_1$–$C_4$)-alkylphosphonomethylbenzonitrile and a 4-di($C_1$–$C_4$)alkylphosphonomethylbenzonitrile simultaneously with one another.

5. A process according to claim 1 wherein the condensation is carried out in the presence of a $C_1$–$C_3$ aliphatic alcohol.

* * * * *